US007203442B2

(12) United States Patent
Matsubara et al.

(10) Patent No.: US 7,203,442 B2
(45) Date of Patent: Apr. 10, 2007

(54) IMAGE FORMING APPARATUS, UNIT MOUNTABLE THERETO AND SEPARATING MEMBER

(75) Inventors: Hideyuki Matsubara, Mishima (JP); Daisuke Abe, Shizuoko-ken (JP); Naoki Matsumaru, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 11/072,506

(22) Filed: Mar. 7, 2005

(65) Prior Publication Data

US 2005/0201773 A1 Sep. 15, 2005

(30) Foreign Application Priority Data

Mar. 9, 2004 (JP) ..... 2004-066364

(51) Int. Cl.
*G03G 15/00* (2006.01)

(52) U.S. Cl. ..... 399/90; 399/111

(58) Field of Classification Search ..... 099/111, 099/90, 107, 108

See application file for complete search history.

(56) References Cited

U.S. PATENT DOCUMENTS

| | | | | |
|---|---|---|---|---|
| 6,334,035 | B1 | 12/2001 | Abe et al. | 399/106 |
| 6,377,759 | B1 | 4/2002 | Abe et al. | 399/27 |
| 6,463,225 | B1 | 10/2002 | Abe et al. | 399/27 |
| 6,473,585 | B2 | 10/2002 | Abe et al. | 399/254 |
| 6,505,008 | B2 | 1/2003 | Abe | 399/27 |
| 6,535,699 | B1 | 3/2003 | Abe et al. | 399/27 |
| 6,560,423 | B2 | 5/2003 | Matsubara | 399/107 |
| 6,701,107 | B2 * | 3/2004 | Karakama et al. | 399/111 |
| 6,823,155 | B2 | 11/2004 | Tsuda et al. | 399/111 |
| 6,934,485 | B2 | 8/2005 | Miyabe et al. | 399/90 |
| 2003/0209464 | A1 | 11/2003 | Otsuka et al. | 206/586 |
| 2003/0215261 | A1 * | 11/2003 | Karakama et al. | 399/111 |
| 2004/0013446 | A1 | 1/2004 | Morioka et al. | 399/111 |
| 2005/0069338 | A1 | 3/2005 | Oguma et al. | 399/90 |

FOREIGN PATENT DOCUMENTS

JP 2003-327293 A 11/2003

OTHER PUBLICATIONS

U.S. Appl. No. 11/091,781, filed Mar. 29, 2005, Daisuke et al.

* cited by examiner

*Primary Examiner*—Susan Lee
(74) *Attorney, Agent, or Firm*—Fitzpatrick, Cella, Harper & Scinto

(57) ABSTRACT

An electrophotographic image forming apparatus is provided for forming an image on a recording material, to which a unit is detachably mountable. The apparatus is transportable with the unit mounted thereto. The apparatus includes (i) a movable member; (ii) a main assembly electrical contact provided on the movable member; (iii) a mounting member demountably mounting the unit; (iv) a unit mounted to the mounting member. The unit has a unit electrical contact electrically contactable to the main assembly electrical contact during image formation on the recording material; and (v) a separating member for separating the main assembly electrical contact and the unit electrical contact from each other by contacting the movable member and the unit to provide a gap between the main assembly electrical contact and the unit electrical contact when the apparatus is transported with the unit mounted to the apparatus.

12 Claims, 16 Drawing Sheets

IMAGE FORMING APPARATUS, UNIT MOUNTABLE THERETO AND SEPARATING MEMBER

FIELD OF THE INVENTION AND RELATED ART

The present invention relates to an electrophotographic image forming apparatus transportable with units mounted therein, and an electrical contact spacing member used in such an electrophotographic image forming apparatus.

In the field of an electrophotographic image forming apparatus (which hereinafter will be referred to simply as image forming apparatus) which forms an image on a recording medium with the use of one of the electrophotographic image formation processes, a cartridge (unit) system has been employed, according to which an electrophotographic photosensitive member, and a single or plurality of processing means, which act on the electrophotographic photosensitive member, are integrally disposed in a cartridge (unitized) to make it possible for them to be removably mountable in the main assembly of the image forming apparatus. Also according to this cartridge system, an image forming apparatus can be maintained by the user himself, without relying on a service person, drastically improving the image forming apparatus in operability. Thus, the cartridge system is widely in use in the field of an image forming apparatus.

In an image forming apparatus such as the one described above, voltage must be applied to the charging means for charging the electrophotographic photosensitive member (which hereinafter will be referred to simply as photosensitive drum), the developing means, etc.

Therefore, as a cartridge is mounted into the main assembly of the image forming apparatus, the electrical contacts on the main assembly side of the image forming apparatus become electrically connected to the electrical contacts on the cartridge side, and voltage is applied from the apparatus main assembly to the cartridge.

In recent years, various products, which employ a cartridge with a memory (storage element) for storing various service data and process data, have been realized. For example, an image forming apparatus which employs such a memory has been substantially improved in image quality, cartridge maintenance, etc., based on the data stored in the memory thereof. In the case of such an image forming apparatus, as the electrical contacts on the main assembly side become electrically connected to the electrical contacts of the memory of a process cartridge, data are exchanged between the apparatus main assembly and the memory.

As described above, an image forming apparatus and a process cartridge therefor are provided with various electrical contacts. Therefore, generally, when transporting an image forming apparatus, the image forming apparatus and the process cartridge therefor are individually wrapped, that is, the process cartridge is not mounted in the apparatus main assembly, in order to prevent the electrical contacts from being frictionally worn or deformed. More specifically, the individually wrapped apparatus main assembly and cartridge are placed in the same box for transportation. Thus, the shipment box for such a packaging method is substantially greater in size than a shipment box for transporting an image forming apparatus with a process cartridge mounted therein, increasing thereby the transportation cost.

Thus, a jig for making it possible to wrap an image forming apparatus, with an individually wrapped toner cartridge disposed in the sheet storage space in which sheets of a recording medium conveyed from the image formation station are to be stored, has been proposed (Japanese Laid-open Patent Application 2003-327293).

According to the abovementioned prior art, however, a wrapping material, which makes it possible to fit a cartridge in the sheet storage portion of an image forming apparatus, is necessary. Further, this art is not applicable to an image forming apparatus which discharges a sheet upward, and an image forming apparatus, the sheet storage space of which is smaller than the toner cartridge therefor.

The present invention was made in consideration of the above described prior art.

SUMMARY OF THE INVENTION

The primary object of the present invention is to provide an electrophotographic image forming apparatus, a unit and a separating member wherein the image forming apparatus can be transported without damaging the electrical contacts on the main assembly side of the image forming apparatus and those on the unit side, while keeping a unit mounted in the main assembly, and also, to provide an electrical contact spacing member.

Another object of the present invention is to provide an electrophotographic image forming apparatus, a unit and a spacing member in which the unit can be kept mounted while preventing the electrical contacts on the main assembly as well as unit sides from being deformed or frictionally worn while the electrophotographic image forming apparatus is transported, and an electrical contact spacing member.

Another object of the present invention is to provide a unit, a separating member and an electrophotographic image forming apparatus higher in the efficiency with which the main assembly thereof, and a unit therefor, are transported than an electrophotographic image forming apparatus in accordance with the prior art, and an electrical contact spacing member.

Another object of the present invention is to provide an electrophotographic image forming apparatus, a unit and a spacing member in which the spacing member is used for keeping the electrical contacts on the main assembly side of the apparatus separated from the electrical contacts on the unit side when transporting the electrophotographic image forming apparatus, with the unit mounted in the apparatus main assembly, and is smaller than a spacing member in accordance with the prior art, and an electrical contact spacing member.

According to an aspect of the present invention, there is provided an electrophotographic image forming apparatus for forming an image on a recording material, to which a unit is detachably mountable, wherein the electrophotographic image forming apparatus is transportable with the unit mounted thereto, the electrophotographic image forming apparatus comprising (i) a movable member; (ii) a main assembly electrical contact provided on the movable member; (iii) a mounting member for demountably mounting the unit; (iv) a unit mounted to the mounting member, wherein the unit has a unit electrical contact electrically contactable to the main assembly electrical contact in an image forming operation for forming the image on the recording material; and (v) a separating member for separating the main assembly electrical contact and the unit electrical contact from each other by contacting the movable member and the unit to provide a gap between the main assembly electrical contact and the unit electrical contact when the electrophotographic image forming apparatus is transported with the unit mounted to the electrophotographic image forming apparatus.

According to another aspect of the present invention, there is provided a separating member usable when an electrophotographic image forming apparatus is transported with a unit mounted thereto, wherein the unit has a unit electrical contact and is detachably mountable to the electrophotographic image forming apparatus, and the electrophotographic image forming apparatus is capable of forming an image on a recording material and has a main assembly electrical contact contactable to the unit electrical contact in an image forming operation for forming an image on the recording material with the unit mounted to the electrophotographic image forming apparatus, the improvement residing in that: the separating member is effective to separate the main assembly electrical contact and the unit electrical contact by providing a gap between the main assembly electrical contact and the unit electrical contact by contacting to the unit and to a movable member, when the electrophotographic image forming apparatus is transported with the unit is mounted to the electrophotographic image forming apparatus, wherein the movable member is provided in the main assembly of the apparatus and supports the main assembly electrical contact.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. Incidentally, the sizes, materials, shapes, and functions of the structural components, and the positional relationships among the structural components, in the following embodiments of the present invention, are not intended to limit the scope of the present invention, unless specifically noted. Further, once a given structural component is described, it will be the same in material, shape, etc., throughout this document, unless specifically noted.

[Embodiment 1]

Next, the first embodiment of the present invention will be described with reference to the drawings.

(Structures of Electrophotographic Image Forming Apparatus and Process Cartridge)

First, referring to FIGS. 3 and 4, the main assembly of the electrophotographic image forming apparatus in which a process cartridge as a unit is removably mountable, and the process cartridge removably mountable in the main assembly, will be described regarding the general structures thereof.

Figure 3:
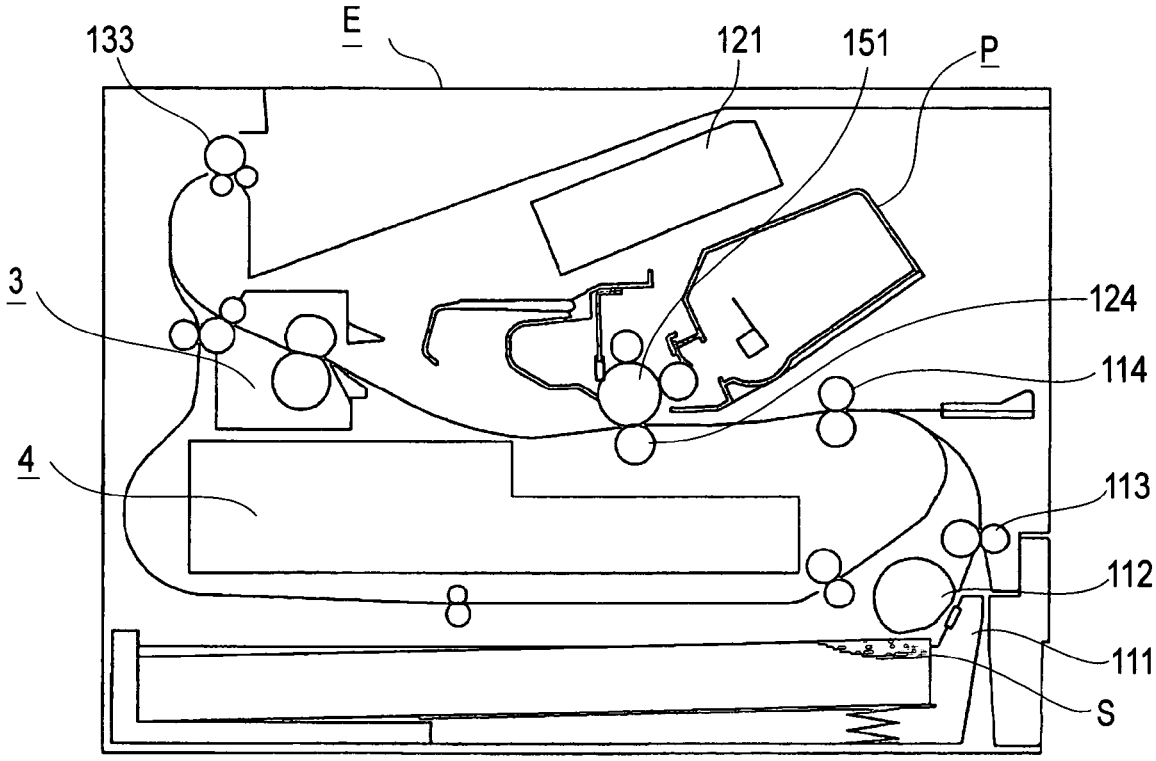
FIG. 3 is a schematic sectional view of the electrophotographic image forming apparatus in the first embodiment of the present invention, (which is laser beam printer), showing the general structure thereof.

FIG. 3 is a schematic sectional view of the laser beam printer, as an example of an electrophotographic image forming apparatus, in this embodiment, showing the general structure thereof. FIG. 4 is a schematic sectional view of the process cartridge removably mountable in the laser beam printer, and the electrical contacts of the cartridge, showing the general structures thereof.

First, the general structure of the main assembly of the image forming apparatus, and the general structure of the process cartridge, will be described, following the flow of a sheet of recording medium S in the main assembly. The laser beam printer E (which hereinafter will be referred to as apparatus main assembly) forms an image with the use of an electrophotographic method. More specifically, the sheet S of recording medium is conveyed by conveying means 112–114 to an image formation station, in which an image formed of toner is transferred onto the sheet S of recording medium. Then, the sheet S of recording medium is conveyed to a fixing means 3, in which the image formed of toner is fixed to the sheet S. Then, the sheet S is discharged into the delivery station.

More specifically, in the bottom portion of the apparatus main assembly E, there is mounted a cassette 111, in which sheets S of recording medium are stored in layers. The sheets S in the cassette 111 are sequentially moved out, one by one, from the cassette 111, starting from the first sheet on the top side, by a conveyance roller 112 which rotates in the counterclockwise direction. Then, the sheets S of recording medium are sequentially sent to the image formation station 3 by pairs of conveyance rollers 113 and 114.

In the image formation station 2, a beam of laser light is projected, while being modulated with image formation data, from a laser scanner 121 onto the peripheral surface of the rotating photosensitive drum 151. As a result, an electrostatic latent image is formed on the peripheral surface of the photosensitive drum 151. This electrostatic latent image is developed by a development roller 157 and toner as developer, in the process cartridge P (which hereinafter will be referred simply as cartridge P).

The image developed by the development roller 157 is transferred by a transfer roller 124 from the photosensitive drum 151 onto the sheet S of recording medium. Then, the sheet S is conveyed to the fixation station 3, through which the sheet S is conveyed while being subjected to the fixation process. Thereafter, the sheet S is discharged by the pair of conveyance rollers 133 into the delivery station.

An electrical component portion 4 shown in FIG. 3 has an electrical power source for the apparatus, and a control circuit for controlling the apparatus.

The cartridge P comprises: the rotatably supported photosensitive drum 151; and a charge roller 152 as a charging means for uniformly charging the peripheral surface of the photosensitive drum 151 by applying voltage to the peripheral surface thereof.

The voltage generated in the electrical component portion 4 of the apparatus main assembly E is supplied to the charge roller 152 through the electrical contact 125 on the main assembly side, and the electrical contact 153 (for charge voltage) on the cartridge side. Next, a beam of laser light is projected, while being modulated with image formation data, from the laser scanner 121, onto the peripheral surface of the photosensitive drum 151, forming thereby a latent image on the peripheral surface of the photosensitive drum 151. This latent image is developed by the development roller 157 and toner.

To describe in even more detail, the charge roller 152 is placed in contact with the photosensitive drum 151 to charge the photosensitive drum 151. It is rotated by the rotation of the photosensitive drum 151.

The toner in a toner container 154 is sent into the development chamber 156 by the rotation of the stirring member 155. As the development roller 157, in the hollow of which a magnetic roller (stationary magnet) is stationarily disposed, is rotated in the development chamber 156, a uniform layer of frictionally charged toner is formed on the peripheral surface of the development roller 157 by the development blade 158. The toner on the peripheral surface of the development roller 157 is transferred onto the peripheral surface of the photosensitive drum 151 in the pattern of the latent image, by applying voltage to the development roller 157. As a result, the latent image is developed; it is developed into an image formed of toner. The voltage to be applied to the development roller 157 is supplied from the electrical component portion 4 to the development roller 157 through the electrical contact 126 (for development) on the main assembly side, and the electrical contact 165 (for development) of the cartridge P.

Not only does the development blade 158 regulate the thickness in which toner is layered on the peripheral surface of the development roller 157, but also, it gives the toner triboelectric charge.

After the transfer of the toner image onto the sheet S of recording medium by the transfer roller 124, the photosensitive drum 151 is cleared of the toner remaining thereon (residual toner), by the cleaning means, and is used for the following image formation process. The cleaning means is provided with an elastic cleaning blade 159, which is disposed in contact with the peripheral surface of the photosensitive drum 151. The elastic cleaning blade 159 scrapes down the residual toner on the peripheral surface of the photosensitive drum 151, and collects the removed residual toner into the waste toner bin 160.

The cartridge P is provided with a memory tag 6 as an information storage medium, which is attached to one of the surfaces of the cartridge P. The main assembly of the image forming apparatus is provided with a connector 7, which is provided with the electrical contacts 72 (first electrical contacts). The memory tag 6 is to be electrically connected to these electrical contacts 72 to allow the memory tag 6 to communicate with the apparatus main assembly E.

When the cartridge P is out of the apparatus main assembly E, the drum shutter 161 of the cartridge P remains shut for drum protection. As the cartridge P is mounted into the apparatus main assembly E, the drum shutter 161 opens, and remains open while the cartridge P is in the apparatus main assembly E (FIGS. 3 and 4).

Next, the frame of the process cartridge P will be described.

Figure 4:
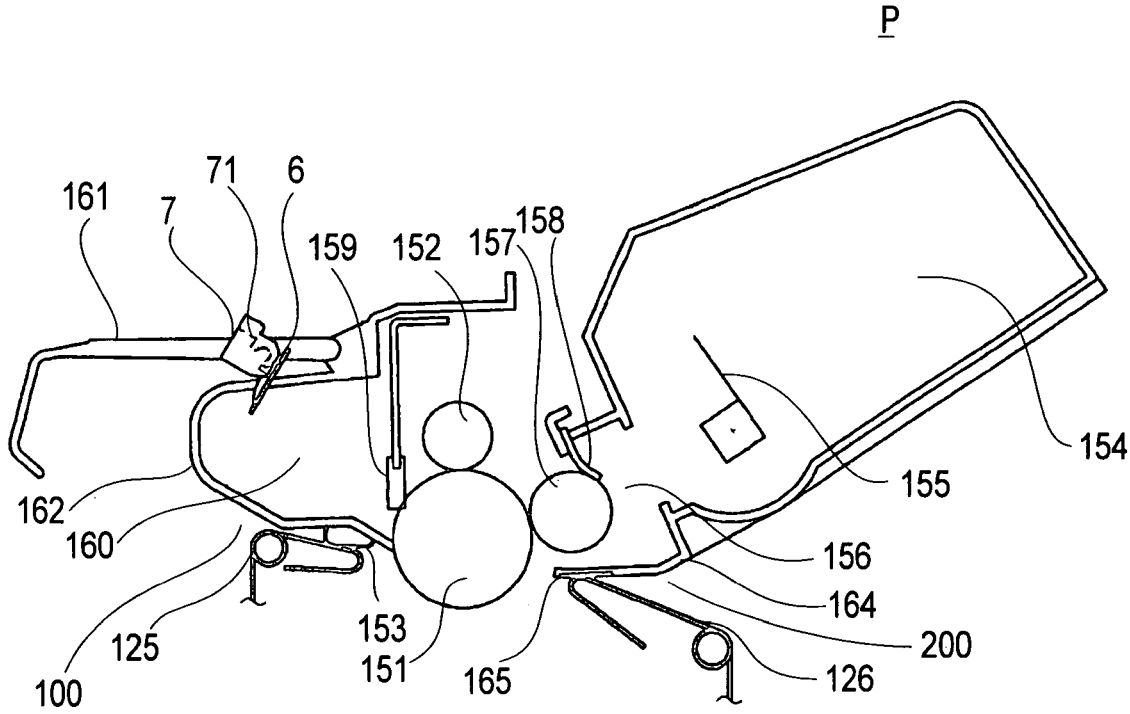
FIG. 4 is a schematic sectional view of the removably mountable process cartridge and the electrical contacts thereof in the first embodiment of the present invention, showing the general structures thereof.

Referring to FIG. 4, the photosensitive drum 151, the charge roller 152, and the cleaning blade 159 are integrally attached to the drum frame 162, which is one of the sub-frames of the cartridge frame, constituting a photosensitive drum unit 100.

As for the development unit 200, it is made up of: the toner container 154 which stores toner; development roller 157; development blade 158; and developing means frame 164 which supports the development roller 157 and the development blade 158.

The photosensitive drum unit 100 and developing means unit 200 are connected to each other with the use of pins (unshown) so that they are enabled to pivot about the pins relative to each other.

(Structure for Mounting or Dismounting Process Cartridge, and Structure of Process Cartridge Compartment)

Next, referring to FIGS. 5–10, the guides for guiding the cartridge P when mounting or dismounting the process cartridge P, and the structure of the cartridge compartment, will be described.

Figure 5:
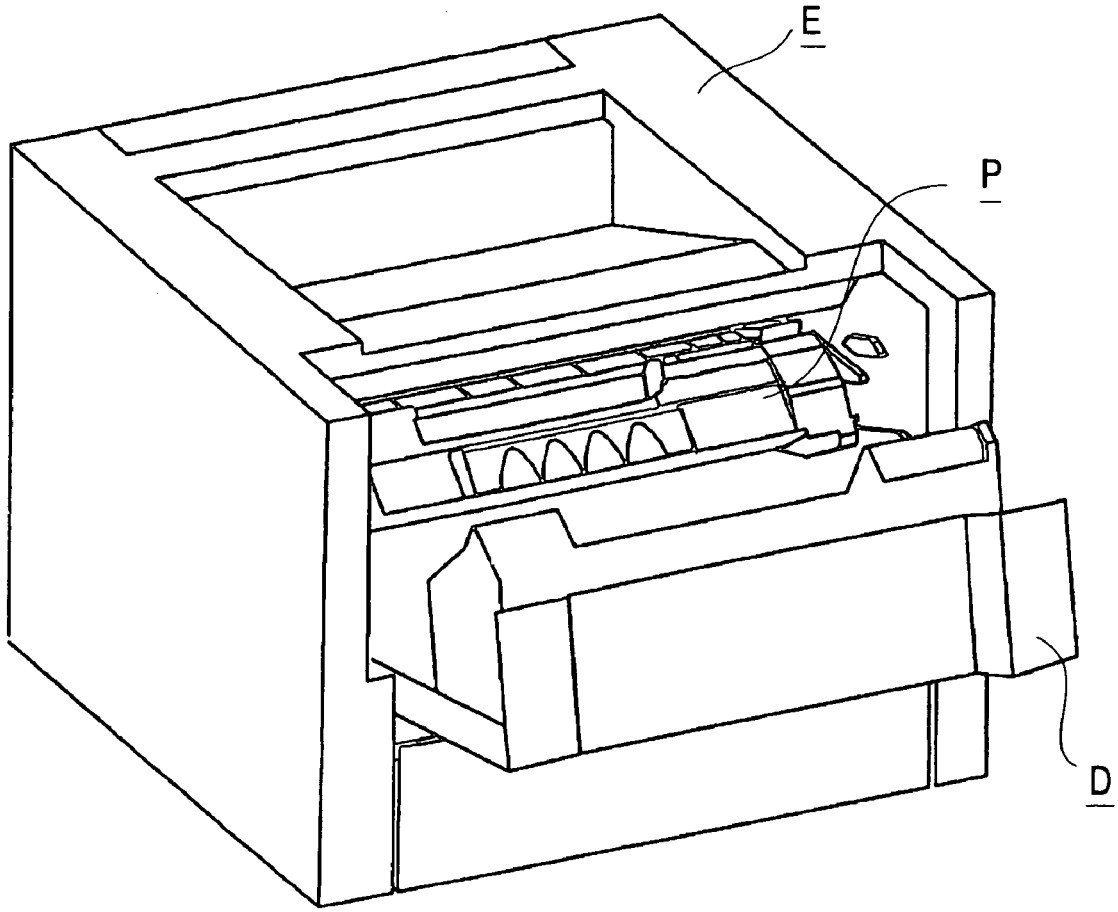
FIG. 5 is a schematic perspective view of the main assembly of the image forming apparatus in the first embodiment of the present invention, the door D, as a hinged member of which, is open for mounting or dismounting of the cartridge P.
Figure 6:
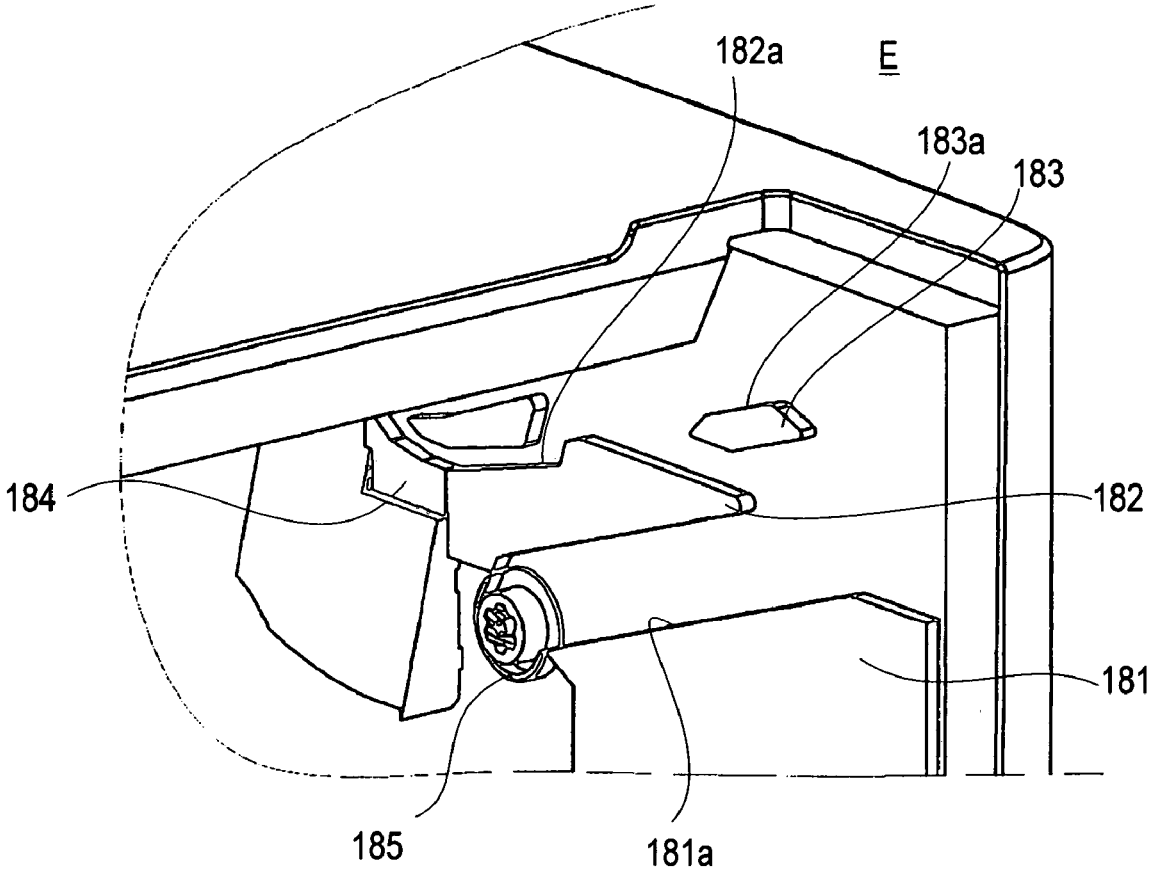
FIG. 6 is a schematic perspective view of the process cartridge mounting means of the apparatus main assembly E in the first embodiment of the present invention.
Figure 7:
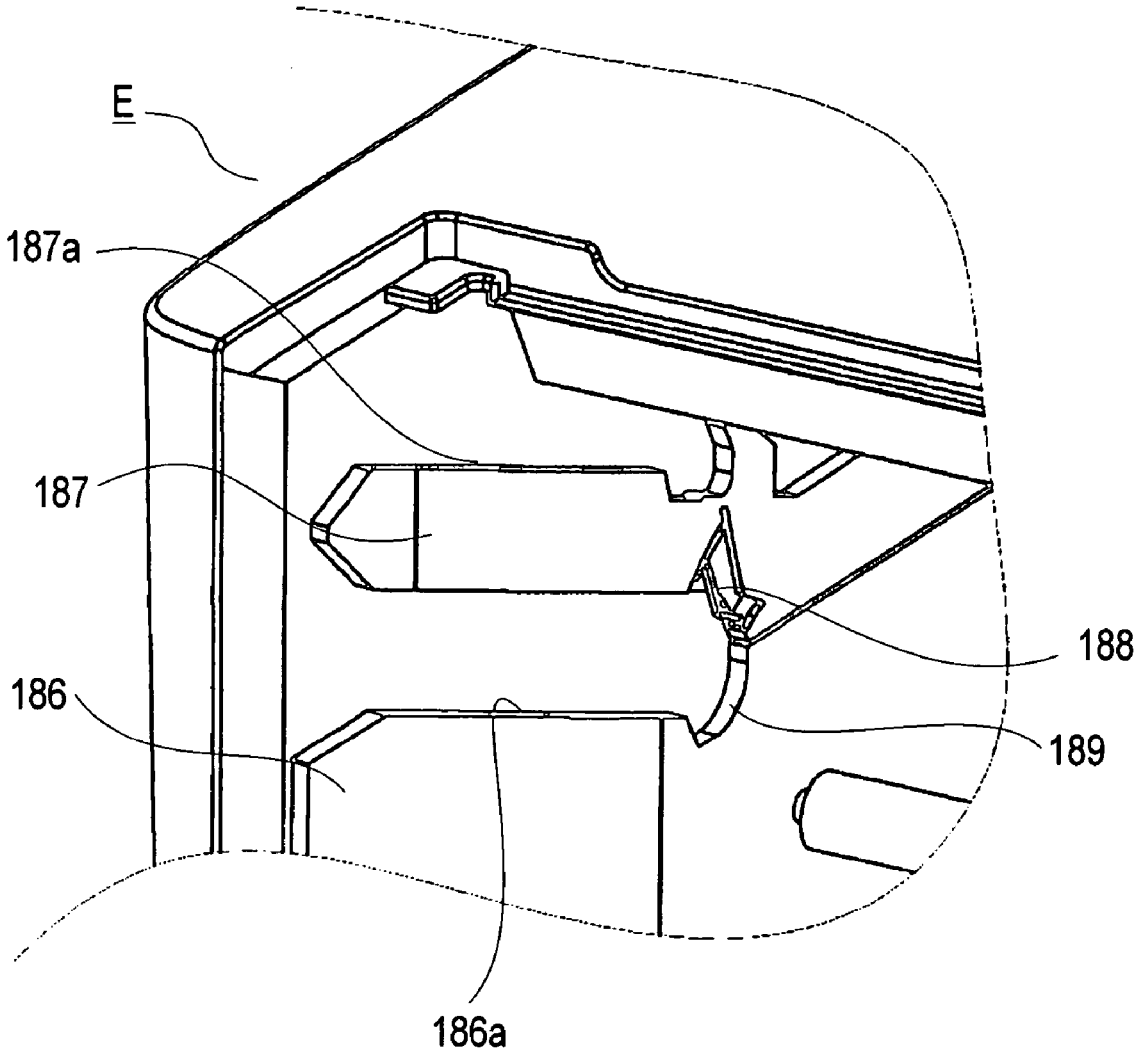
FIG. 7 is also a schematic perspective view of the process cartridge mounting means of the apparatus main assembly E in the first embodiment of the present invention.
Figure 8:
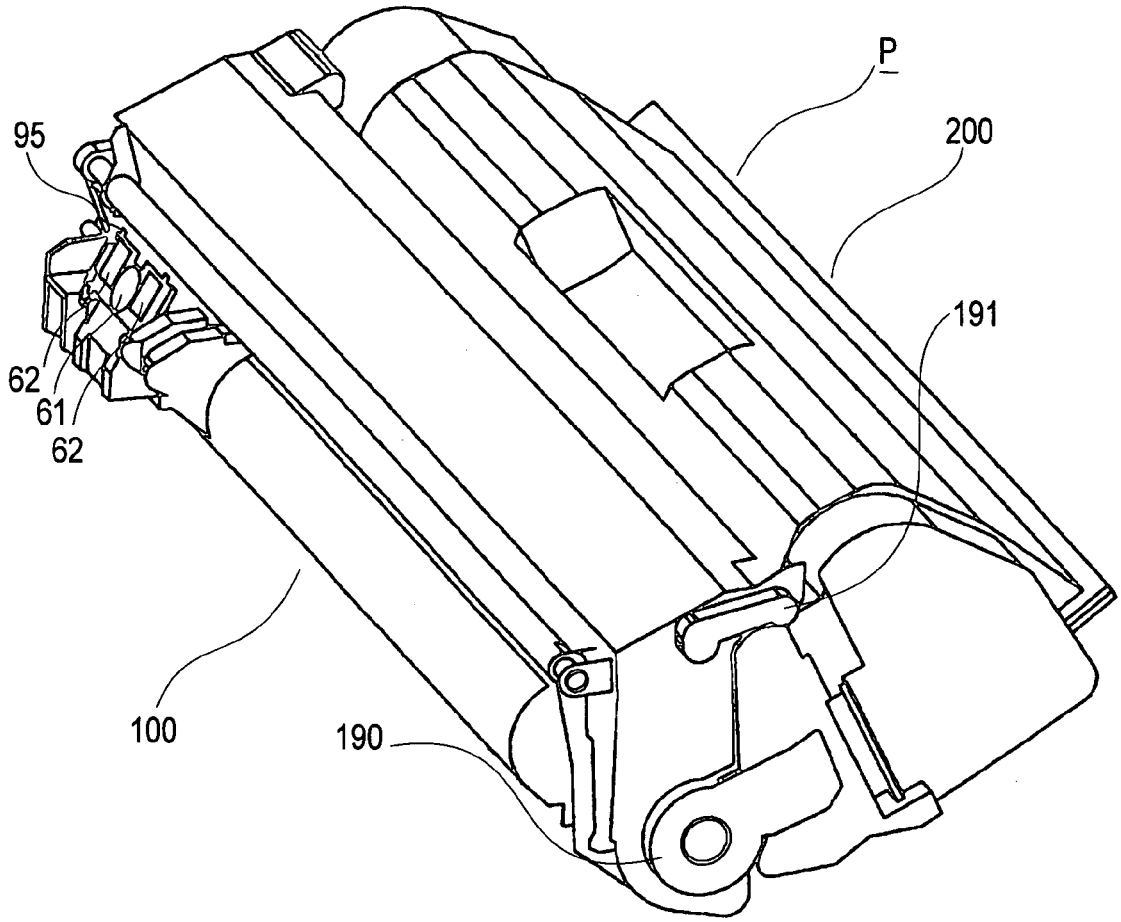
FIG. 8 is a schematic perspective view of the process cartridge in the first embodiment of the present invention.
Figure 9:
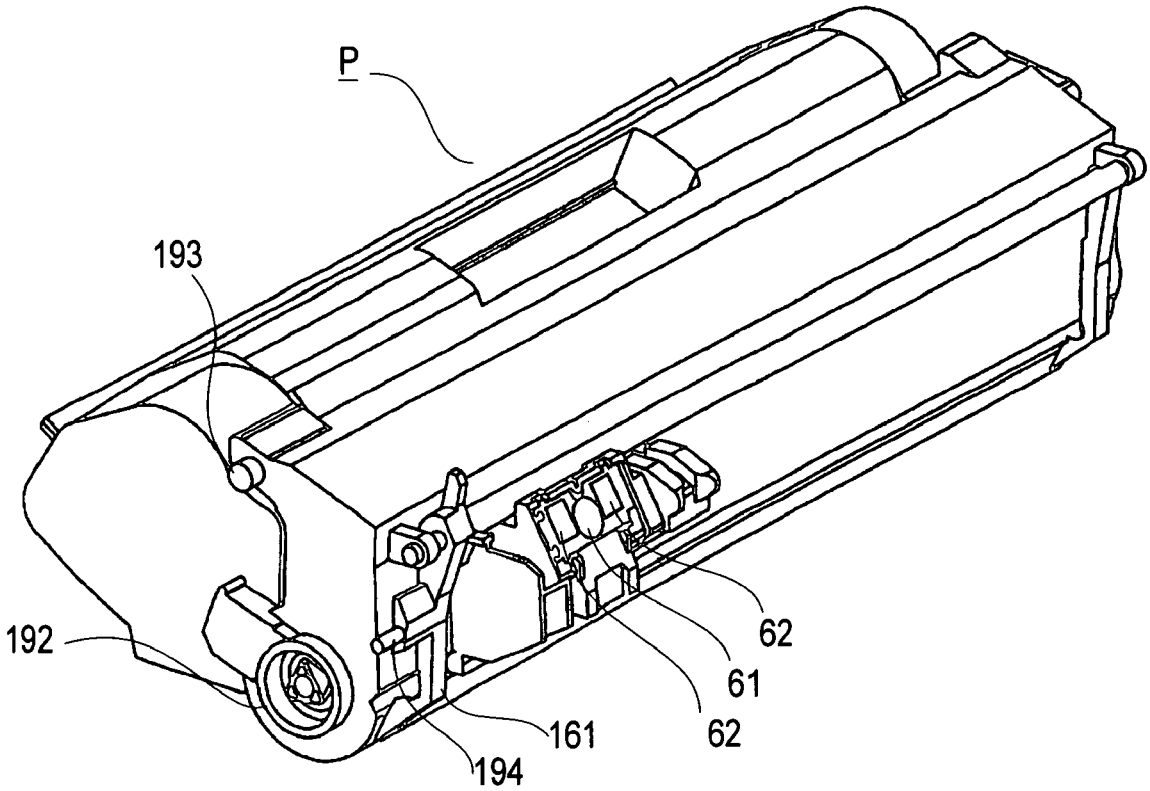
FIG. 9 is also a schematic perspective view of the process cartridge in the first embodiment of the present invention.
Figure 10:
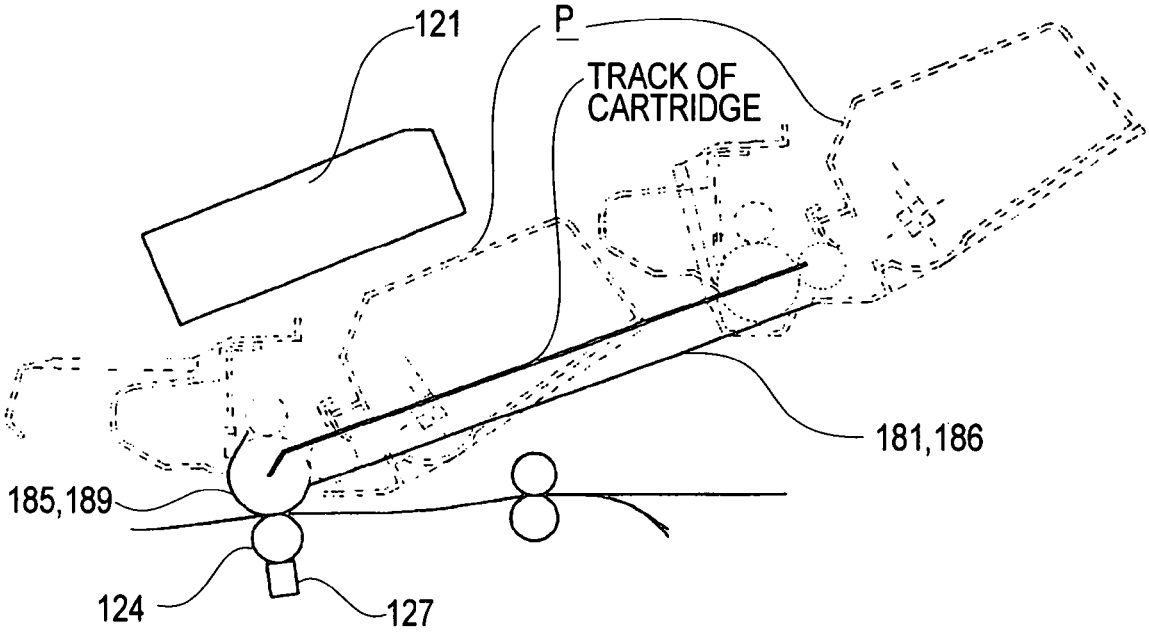
FIG. 10 is a drawing showing the track which the process cartridge in the first embodiment of the present invention follows when it is inserted or extracted.

FIG. 5 is a schematic perspective view of the main assembly of the image forming apparatus, the door D, as a hinged member of which, is open for mounting or dismounting of the cartridge P. FIGS. 6 and 7 are schematic perspective views of the process cartridge mounting means of the apparatus main assembly E. FIGS. 8 and 9 are schematic perspective views of the process cartridge. FIG. 10 is a drawing showing the track which the process cartridge follows when it is mounted or removed.

Referring to FIG. 5, a user is to open the door D as a hinged member of the apparatus main assembly E so that the cartridge P can be removably mounted into the cartridge compartment 300 of the apparatus main assembly E.

First, the guiding members, etc., with which the cartridge P is provided, will be described. Referring to FIGS. 8 and 9, the cartridge P is provided with cartridge guiding portions, more specifically, a pair of roughly cylindrical portions 190 and 192, which are on the end surfaces of the cartridge P, one for one, in terms of the lengthwise direction of the cartridge P. The cartridge P is also provided with a pair of mechanical contact portions 191 and 193 for regulating the rotation of the cartridge P which occurs as the cartridge P is mounted into the apparatus main assembly E. The mechanical contact portions 191 and 193 are on the lengthwise end surfaces of the cartridge P, being located roughly at the top edges thereof, one for one.

Next, the guiding members with which the apparatus main assembly E is provided will be described. The guiding means on the main assembly side is made up of guiding members 181–189. The guiding members 181 and 186 have surfaces 181*a* and 186*a*, respectively, which are slanted relative to the direction in which cartridge P is mounted. Further, the guiding members 181 and 186 are continuous with the guiding members 185 and 189, respectively, having a recessively curved surface. As the cartridge P is inserted into the apparatus main assembly E, it is guided inward of the apparatus main assembly E, with the roughly cylindrical portions 192 and 190 of the cartridge P guided by the guiding members 181 and 186, respectively, of the main assembly E.

As for the guiding members 182, 183, and 187, they have surfaces 182*a*, 183*a*, and 187*a*, respectively, which also are slanted relative to the abovementioned cartridge insertion direction. Thus, as the cartridge P is inserted into the apparatus main assembly E, the cartridge P is guided inward of the apparatus main assembly E, with the abovementioned mechanical contact portions 193 of the cartridge P guided by the slanted surfaces 182*a* and 183*a*, and the mechanical contact portion 191 guided by the slanted surface 187*a*. The drum shutter 161 opens or closes as a cylindrical portion 194 of the cartridge P is guided by the guiding members 182 and 184.

Next, referring to FIG. 10, the track which the cartridge P follows as it is mounted into the apparatus main assembly E or removed therefrom, will be described. When mounting the cartridge P into the apparatus main assembly E, the cartridge P is to be inserted into the apparatus main assembly A in the roughly horizontal direction. Initially, that is, while the leading end of the cartridge P is in the adjacency of the upstream end of the cartridge compartment, the cartridge P remains roughly horizontal. Eventually, the cartridge P is tilted in the direction intersecting the aforementioned cartridge insertion direction, while being inserted into the its final position from above the transfer roller 124. After the successful completion of the mounting of the cartridge P, the cylindrical portion 190 of the cartridge P is pressed on the guiding member 189 by a cartridge pressing spring 188.

In this embodiment, the apparatus main assembly E is packaged in the shipment box, with the cartridge P remaining mounted in the apparatus main assembly E, to be delivered to an end user.

(Structure of Memory Tag and Structure of Connector on Main Assembly Side)

Next, referring to FIGS. 4, 11, 12, and 13, the structure of the memory tag, and the structure of the connector on the main assembly side, will be described. First, the structure of the memory tag will be described.

Figure 11:
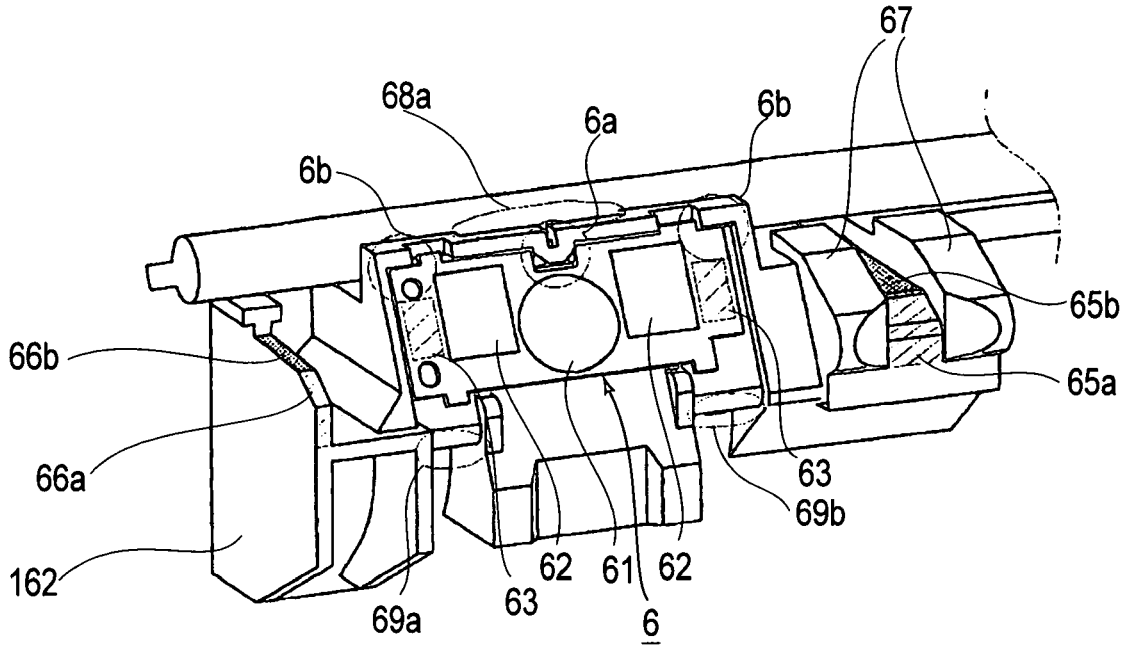
FIG. 11 is a perspective view of the memory tag attachment portion of the process cartridge, and its adjacencies, in the first embodiment of the present invention.

Referring to FIG. 4, the cartridge P is provided with the memory tag 6, which is in the form of a piece of plate and is attached to one of the surfaces of the drum frame 162. Referring to FIG. 11, the memory tag 6 comprises: a storage portion 61; electrical contacts 62 (second electrical contacts) on the unit side; mechanical contact portions 63; and a substructural plate (print substrate) on which the preceding components are disposed.

The storage portion 61 is located in the middle of the print substrate, and the storage element (unshown) of the storage portion 61 is protected with a protective layer of resin. The electrical contacts 62 are disposed on the same surface of the print substrate as the storage portion, one on each side of the storage portion 61, and being aligned in the direction parallel to the lengthwise direction. The mechanical contact portions 63 are where the mechanical contact portions 71 of the connector 7, as a member for supporting the electrical contacts on the main assembly side, make contact, one for one. The connector 7 will be described later. Also referring to FIG. 11, the mechanical contact portions 63 with which the mechanical contact portions 71 make contact are disposed next to the outward side of the electrical contacts 62, one for one, in terms of the lengthwise direction, and are aligned in the direction parallel to the lengthwise direction. The storage element stores the information regarding the cartridge P.

Figure 12:
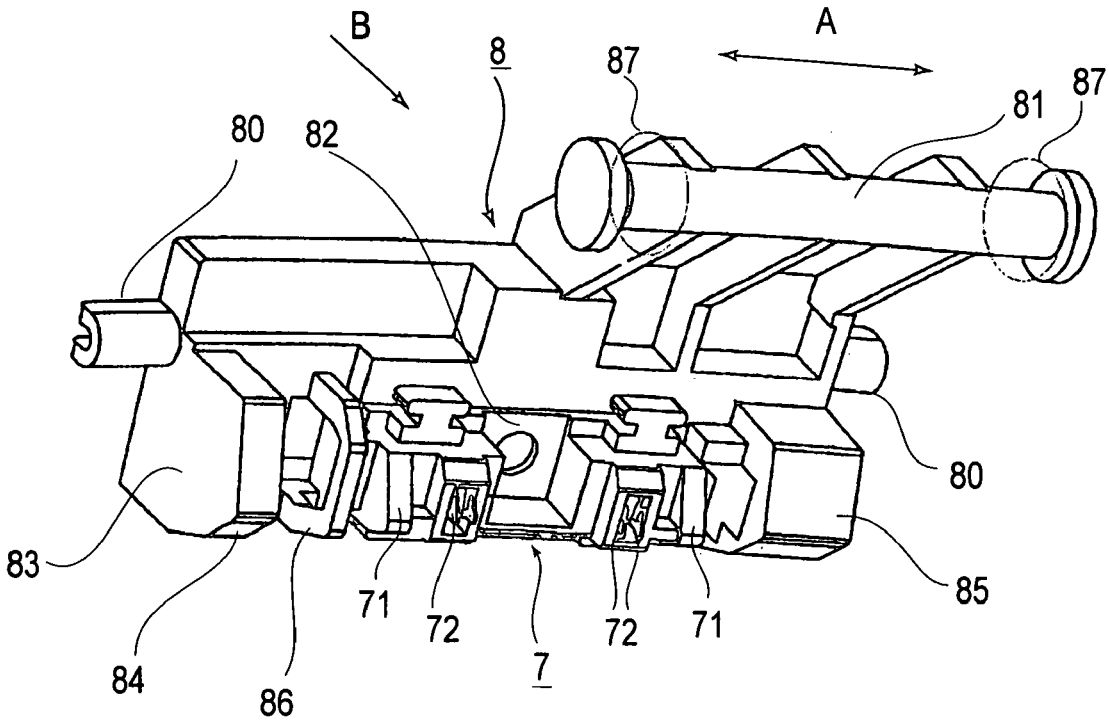
FIG. 12 is a perspective view of the connector attachment portion of the main assembly of the image forming apparatus, and its adjacencies, in the first embodiment of the present invention.
Figure 13:
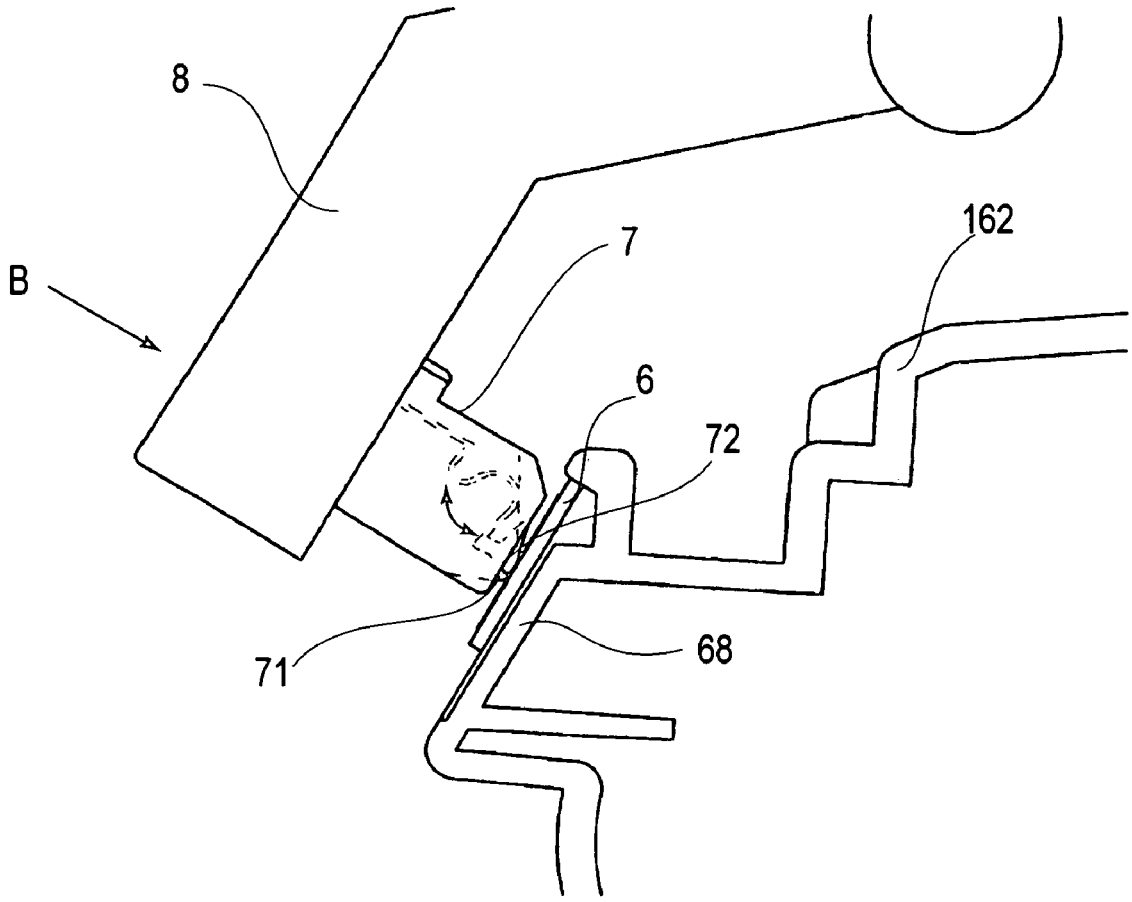
FIG. 13 is a schematic sectional view of the contact area between the process cartridge and the main assembly of the image forming apparatus, and its adjacencies, in the first embodiment of the present invention, after the mounting of the process cartridge into the main assembly.

Referring to FIG. 13, the connector 7 is provided with the electrical contacts 72 (first electrical contacts) formed of an electrical conductive substance (for example, metal). The electrical contacts 72 generate contact pressure by being elastically deformed. Referring to FIGS. 12 and 13, the amount by which the electrical contacts 72 flex is kept constant by the contact between the mechanical contact portions 71 and mechanical contact portions 63, one for one. Therefore, the contact pressure between the electrical contacts 62 of the memory tag 6 and the electrical contacts 72 on the main assembly side are kept constant, and therefore, the electrical conduction between the memory tag 6 and the apparatus main assembly E remains stable.

Next, the structural arrangement for attaching the memory tag 6 to the cartridge P will be described. One of the longer edges of the memory tag 6 is provided with a recess 6*a*, the location of which is between the two electrical contacts 62 in terms of the lengthwise direction. As for the cartridge P, it is provided with a rib 68*a* as a memory tag positioning portion, which extends in the direction which will be perpendicular to the lengthwise direction of the memory tag 6 after the attachment of the memory tag to the cartridge P. When attaching the memory tag 6 to the cartridge P, the rib 68*a* is to be engaged with the recess 6*a*, so that the memory tag 6 (groove 6*a*) is precisely positioned relative to the cartridge P in terms of the lengthwise direction of the memory tag 6. As for the positioning of the memory tag 6 in terms of the widthwise direction, the memory tag 6 is precisely positioned relative to the cartridge P by placing the memory tag 6 in contact with the memory tag positioning portions 6*b* of the cartridge P.

Next, the structure of the portion of the drum frame 162 to which the memory tag 6 is attached, and the adjacencies thereof, will be described. The frame 162 is provided with a positioning portion 67 for precisely positioning the connector holder 8 (which will be described later) with which the apparatus main assembly E is provided. Further, the frame 162 is provided with mechanical contact portions 65*a* and 66*a*, which are located next to the memory tag attachment portion 68 in terms of the lengthwise direction. The mechanical contact portions 65*a* and 66*a* are for preventing the electrical contacts 72 from coming into contact with the portions other than the electrical contacts 62 during the mounting of the cartridge P.

Next, the structure of the connector 7 of the apparatus main assembly E will be described. Referring to FIG. 12, the connector 7 is provided with the electrical contacts 72 (first electrical contacts), which are formed of an electrical conductive substance (for example, metal) and generate contact pressure by being elastically deformed. There are provided one to two electrical contacts 72 per electrical contact 62 of the memory tag 6. The apparatus main assembly E is also provided with mechanical contact portions 71, which come into contact with the aforementioned mechanical contact portions 63 of the memory tag 6. The mechanical contact portions 71 are located in the outward adjacencies of the electrical contacts 72 in terms of the lengthwise direction of the cartridge P. To the opposite end of each electrical contact 72 from the end thereof, by which the electrical contact 72 is placed in contact with the corresponding electrical contact 62 of memory tag 6, a lead wire is connected, which is connected to the control portion (unshown) of the apparatus main assembly E.

The connector holder 8, which is a movable member, has: a rotational shaft 81; a connector attachment portion 82; a positioning portion 83 for precisely positioning the connector 7 in terms of the lengthwise direction; a rotation control portion 80; and guiding ribs 84 and 85 for preventing the electrical contacts 72 from coming into contact with the portions (of process cartridge frame) other than the electrical contacts 62 of the memory tag 6 during the mounting or dismounting of the cartridge P.

The connector 7, which is a supporting member, is solidly attached to the connector holder 8 with the use of a snap-fitting means 86, screws (unshown), or the like. The connector holder 8 is rotatably supported by the rotational shaft 81 as described above. The rotational shaft 81 is borne by bearing portions 87, being allowed to slide relative to the cartridge P in the lengthwise direction (indicated by arrow mark A). The bearing portions 87 are attached to the apparatus main assembly E. Further, the holder 8 is kept under the pressure generated by a spring (unshown) in the direction indicated by an arrow mark B, and its rotation control portion 80 is in contact with the apparatus main assembly E, controlling thereby the rotation of the holder 8.

(Movement of Memory Tag)

Next, the process through which the connector 7 and memory tag 6 come into contact with each other during the mounting of the cartridge P into the apparatus main assembly E will be described, sequentially following the steps through which the cartridge P is mounted into the apparatus main assembly E.

The holder 8 is enabled to move in the aforementioned lengthwise direction (arrow A direction) as described above. Thus, as the cartridge P is inserted into the apparatus main assembly E, the positioning portion 83 of the holder 8, enters, and engages with, the positioning portion 67 of the cartridge frame 162, which is for precisely positioning the connector holder 8 of the apparatus main assembly E in terms of the lengthwise direction. As a result, the connector 7 is precisely positioned in terms of the lengthwise direction.

As the cartridge P is further inserted, the mechanical contact portions 65*a* and 66*a* of the memory tag 6 come into contact with the guiding ribs 84 and 85 of the holder 8. At the moment of this contact, the electrical contacts-72 and mechanical contact portions 71 have yet to come into contact with the memory tag 6, nor yet with the cartridge frame 162 which is holding the memory tag 6. Then, the cartridge P is further inserted, with the mechanical contact portions 65*a* and 66*a* remaining in contact with the guiding ribs 84 and 85. As the cartridge P is further inserted, the mechanical contact portions 65*a* and 66*a* slide off from the guiding ribs 84 and 85 immediately before the cartridge P is moved into the predetermined position in the apparatus main assembly E. As a result, the clearance providing portions 65*b* and 66*b*, which extend rearward from the mechanical contact portions 65*a* and 66*a* in terms of the cartridge insertion direction, oppose the guiding ribs 84 and 85, becoming thereby separated from the cartridge frame 162, and at the same time, the mechanical contact portions 63 come into contact with the mechanical contact portions 71, one for one. Consequently, an electrical connection is established between the electrical contacts 62 of the memory tag 6 and the electrical contacts 72, and the predetermined amount of contact pressure is generated, and maintained thereafter, between the electrical contacts 62 and electrical contact 72, one for one.

(Structure of Electrical Contact Spacing Member and Functions Thereof During Mounting of Process Cartridge)

Figure 1:
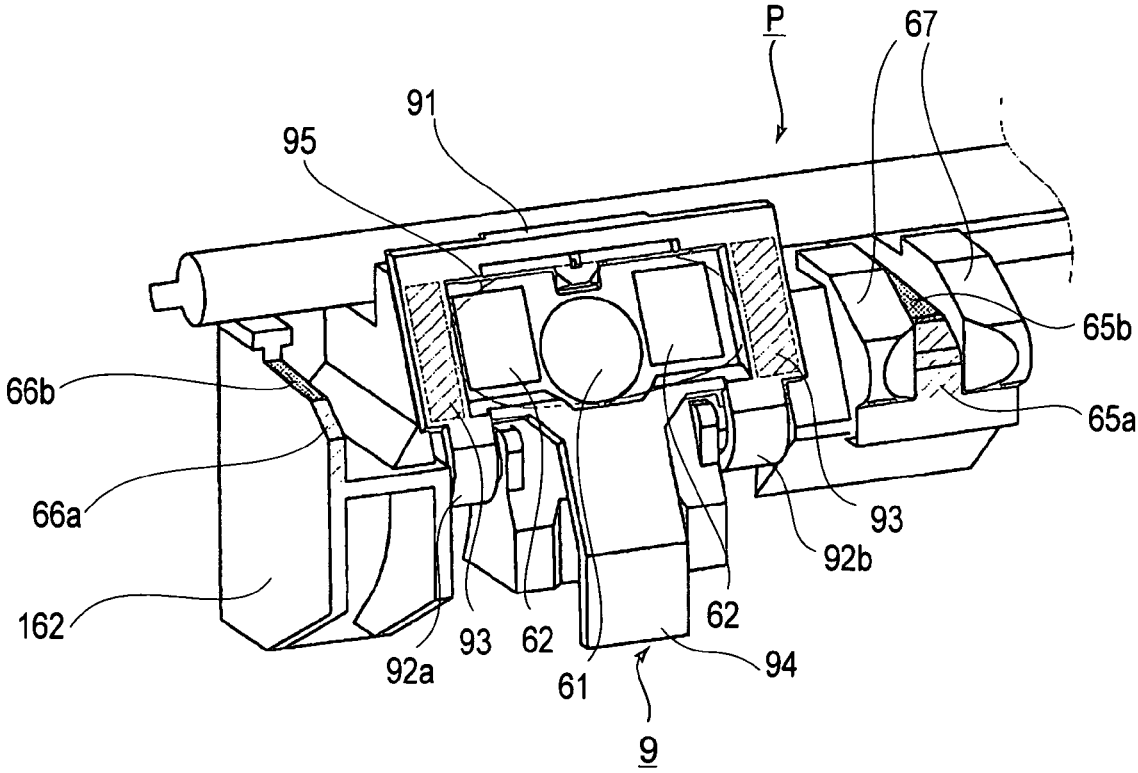
FIG. 1 is a perspective view of the memory tag attachment portion of the process cartridge, and its adjacencies, in the first embodiment of the present invention, at the time of mounting the electrical contact spacing member.
Figure 2:
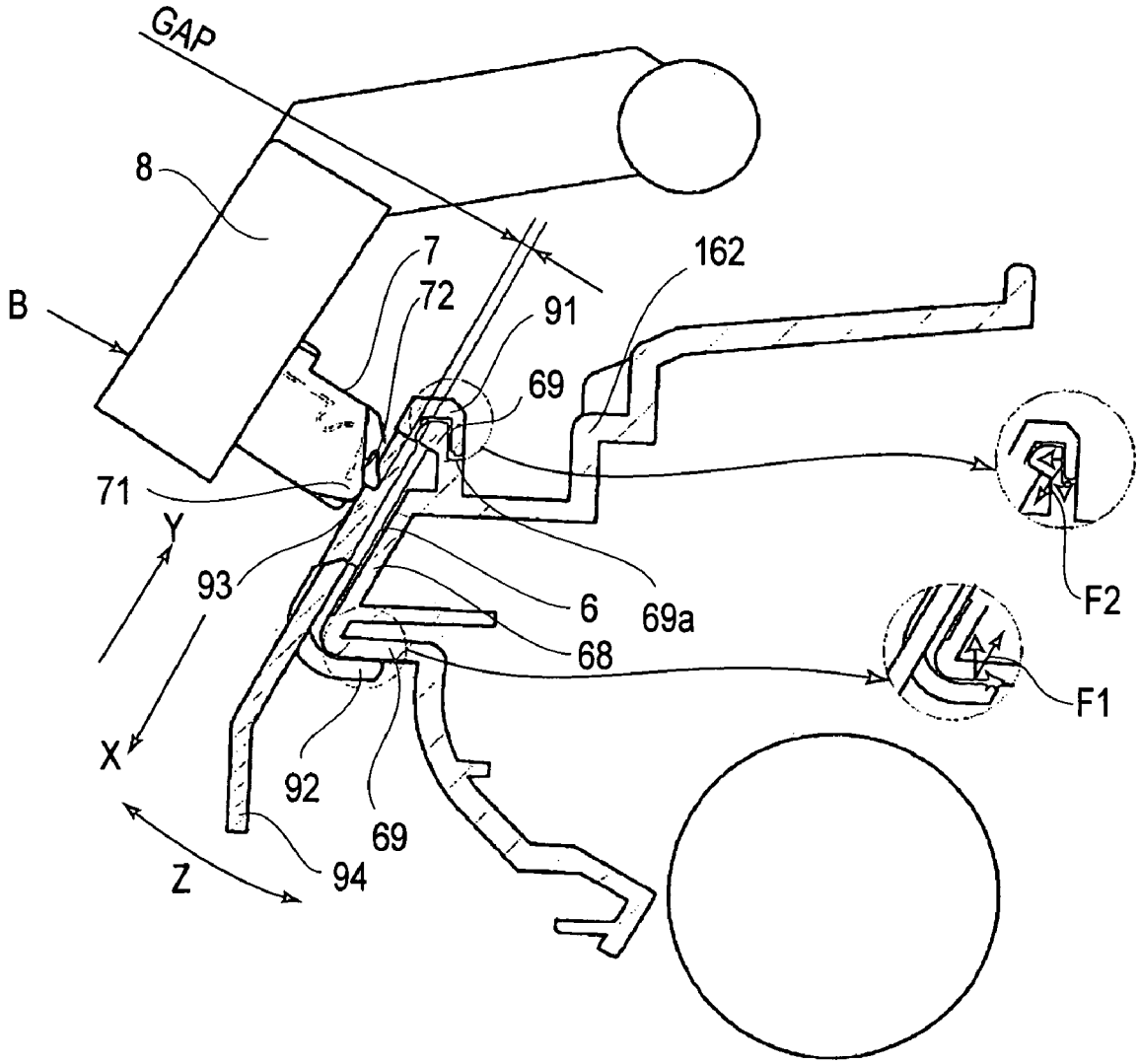
FIG. 2 is a schematic sectional view of the memory tag attachment portion of the cartridge P, its adjacencies, and electrical contact spacing member 9, in the first embodiment of the present invention, after the mounting of the cartridge P fitted with the spacing member 9 into the apparatus main assembly E.

Referring to FIGS. 1 and 2, the electrical contact spacing member (which hereinafter will be referred to simply as the spacing member) for keeping the electrical contacts 62 isolated from the electrical contacts 72 of the apparatus main assembly E in order to prevent the former from coming into contact with the latter, while the cartridge P is in the apparatus main assembly E, will be described regarding its structure, and also, the function of the spacing member during the mounting of the cartridge P into the apparatus main assembly E will be described.

FIG. 1 is a perspective view of the memory tag attachment portion of the cartridge P, its adjacencies, and spacing member 9, after the mounting of the spacing member 9. FIG. 2 is a schematic sectional view of the tag attachment portion of the cartridge P, its adjacencies, and spacing member 9, after the mounting of the cartridge P into the apparatus main assembly E, with the cartridge P (memory tag 6) fitted with the spacing member 9.

First, the spacing member attachment portion 68 and the spacing member 9 will be described regarding their structures. The cartridge frame 162 is provided with the spacing member attachment portions 68, 69*a*, and 69*b*, to which the spacing member 9 is to be attached (FIG. 11). These spacing member attachment portions 68 and 69 (69*a*, and 69*b*) are positioned so that they align in the direction parallel to the cartridge insertion direction X, in FIG. 2.

The spacing member 9 is provided with an engaging portion 91 by which the spacing member 9 is removably attachable to the frame 162. It also has electrical contact spacing portions 93 (which hereinafter will be referred to simply as the spacing portions), which are mechanical contact portions for keeping the distance between the connector holder 8 and cartridge P greater while the apparatus main assembly E is transported than when the apparatus main assembly E is in use (during image formation).

In this embodiment, the spacing member 9 is also provided with engaging portions 92*a* and 92*b*, which are located on the opposite side of the spacing portions 93 from the engaging portion 91 which can be engaged with, or disengaged from, the drum frame 162. The engaging portions 92*a* and 92*b* can also be engaged with, or disengaged from, the drum frame 162.

As the spacing member 9 is attached to the cartridge P, the spacing portions 93 cover the mechanical contact portions 63 of the memory tag 6 shown in FIG. 11, and is placed in contact with the mechanical contact portions 71 of the connector holder 8. The mechanical contact portions 71 are provided to ensure that the contact pressure between the electrical contacts 62 of the memory tag 6 and the electrical contacts 72 on the main assembly side remains at the predetermined value during the use of the apparatus main assembly E. With the cartridge P fitted with the spacing member 9, the spacing member 9 regulates the position of the connector holder 8 relative to the cartridge P. Therefore, the electrical contacts 62 are prevented from coming into contact with the electrical contacts 72. In other words, a certain amount of gap is maintained between the electrical contacts 62 and electrical contacts 72 as shown in FIG. 2. Therefore, even if the cartridge P is left mounted in the apparatus main assembly E when the apparatus main assembly E is transported, the electrical contacts 72 and electrical contacts 62 are prevented from being damaged (for example, being deformed, frictionally worn, or the like).

Further, the spacing member 9 is provided with holes 95 and a handle portion 94, which is also called a tab portion. The holes 95 are surrounded by the corresponding engaging portions 91, 92*a*, and 92*b*, and the spacing portions 93. The holes 95 correspond in position to the electrical contacts 62, one for one, enabling the spacing member 9 to keep the electrical contacts 62 separated from the electrical contacts 72, without coming into contact with the electrical contacts 72 of the connector 7. In other words, providing the spacing member 9 with the holes 95 makes it possible to reduce the thickness of the spacing member 9, and also, to simplify the shape of the spacing member 9. Therefore, it can reduce the cost of the spacing member 9.

As for the removal of the spacing member 9, the spacing member 9 is to be rotated by the tab portion 94 about the engaging portion 92 in the direction indicated by an arrow mark Z, which is roughly perpendicular to the cartridge insertion direction indicated by an arrow mark X or cartridge removal direction indicated by an arrow mark Y. Since the tab portion 94 is located a certain distance away from the engaging portions 92*a* and 92*b*, the spacing member 9 can be easily removed from the frame 162 by the above described action.

Next, the relationship among the connector 7, the memory tag 6, and the spacing member 9 will be described, sequentially following the steps through which the cartridge P fitted with the spacing member 9 is mounted into the apparatus main assembly E.

As the cartridge P is inserted into the apparatus main assembly E, first, the positioning portion 83 of the connector holder 8 enters, and engages with, the positioning portion 67 of the drum frame 162, precisely positioning the connector holder 8 in terms of the lengthwise direction of the connector 7 (arrow A direction in FIG. 12).

Then, the mechanical contact portions 65*a* and 66*a* of the cartridge P come into contact with the guiding ribs 84 and 85 of the apparatus main assembly E. At the moment of this contact, the electrical contacts 72 and mechanical contact portions 71 of the connector 7 have yet to come into contact with the memory tag 6, the cartridge frame 162 which is holding the memory tag 6, and the spacing member 9. Then, the cartridge P is further inserted, with the mechanical contact portions 65*a* and 66*a* remaining in contact with the guiding ribs 84 and 85. As the cartridge P is further inserted, the mechanical contact portions 65*a* and 66*a* slide off from the guiding ribs 84 and 85 immediately before the cartridge P is moved into the predetermined position in the apparatus main assembly E. As a result, the clearance providing portions 65*b* and 66*b*, which extend rearward from the mechanical contact portions 65*a* and 66*a* in terms of the cartridge insertion direction, oppose the guiding ribs 84 and 85.

At the same time, the mechanical contact portions 71 come into contact with the spacing portions 93, keeping the electrical contacts 72 separated from the electrical contacts 62. Consequently, the electrical contacts 72 are prevented thereafter from coming into contact with the electrical contacts 62.

As the mechanical contact portions 71 of the connector 7 come into contact with the spacing portions 93 of the spacing member 9, and press thereupon, a force F1 is applied to the spacing member 9 in the direction opposite to the cartridge insertion direction. However, as described above, the spacing member 9 is engaged with the spacing member attachment portion of the drum frame 162 so that it will not disengage from the spacing member attachment portion, in the direction intersecting to the cartridge insertion direction or cartridge removal direction. Therefore, even though the spacing member 9 is subjected to the force F1, it does not disengage from the spacing member attachment portion of frame 162.

In other words, the engaging portions 92 (92*a* and 92*b*) located on the leading end of the cartridge P in terms of the cartridge insertion direction X are pressed upon the drum frame 162 as the cartridge P is mounted into the apparatus main assembly E. Therefore, the spacing member 9 does not disengage from the drum frame 162 when the process cartridge P is mounted into the apparatus main assembly E.

As described above, as long as the cartridge P is fitted with the spacing member 9, even after the mounting of the cartridge P into the apparatus main assembly E, the electrical contacts 72 and electrical contacts 92 remain isolated from each other by the spacing member 9, being thereby prevented from being damaged (for example, being deformed, frictionally worn, etc.).

The apparatus main assembly E and the cartridge P therein are delivered to a user while remaining in the above described condition. Then a user is to open the box, in which they have been delivered. Next, the electrophotographic image forming apparatus is to be taken out of the shipment box. Next, the cartridge P is to be removed from the apparatus main assembly E in order to remove the spacing member 9. The following is the description of the detail of the process of removing the spacing member 9.

First, the user is to remove the apparatus main assembly E from the shipment box, and remove the cartridge P from the apparatus main assembly E by opening the door D. When the cartridge P is removed from the apparatus main assembly E, the spacing member 9 is subjected to a force F2 which acts in the direction opposite to the cartridge removal direction. However, as described above, the spacing member 9 and drum frame 162 are structured so that once the spacing member 9 and frame 162 are engaged with each other, they cannot be disengaged in the direction intersecting intersectional to the cartridge insertion or removal direction. Therefore, the spacing member 9 is pressed upon the cartridge P, and therefore, does not become disengaged from the cartridge P.

In other words, when the cartridge P is removed from the apparatus main assembly E, first, the engaging portions 91 located at the leading end of the cartridge P in terms of the cartridge removal direction Y are pressed upon the drum frame 162. Therefore, it does not occur that the spacing member 9 becomes disengaged from the drum frame 162. Incidentally, the force F1 which applies to the engaging portions 92, and the force F2 which applies to the engaging portions 91, have only to be opposite in direction. In other words, the combination may be reversed.

As the cartridge P is moved further outward, the mechanical contact portions 65*a* and 66*a* come into contact with the guiding ribs 84 and 85, which were located opposite the clearance providing portions 65*b* and 66*b* of the drum frame 162. In this condition, the electrical contacts 72 and contact portions of the connector 7 are not in contact with the memory tag 6, the cartridge frame which is supporting the memory tag 6, and the spacing member 9. Then, as the cartridge P in this condition is pulled outward of the apparatus main assembly E, the mechanical contact portions 65*a* and 66*a* become disengaged from the guiding ribs 84 and 85, and the cartridge P comes out of the apparatus main assembly E, with no deformation and/or frictional wear to the electrical contacts 72 nor the electrical contacts 62. Next, the user is to grasp the tab portion 94 of the spacing member 9, and rotate the spacing member 9 by the tab portion 94 in the spacing member removal direction Z (roughly perpendicular to cartridge insertion direction). With this action, the spacing member 9 easily disengages from the drum frame 162.

[Embodiment 2]

Next, the second embodiment of the present invention will be described with reference to the drawings. The components in the second embodiment and thereafter, which are the same in structure and/or function as those in the above described first embodiment, are given the same reference symbols as those given for the description of the first embodiment, and will not be described, except for their aspects which characterize the following embodiments. The second embodiment is substantially different from the first embodiment in that the electrical contact spacing member 29 is attached to the apparatus main assembly E instead of the cartridge P.

(Structure of Spacing Member, and Functions Thereof During Mounting of Process Cartridge)

Figure 14:
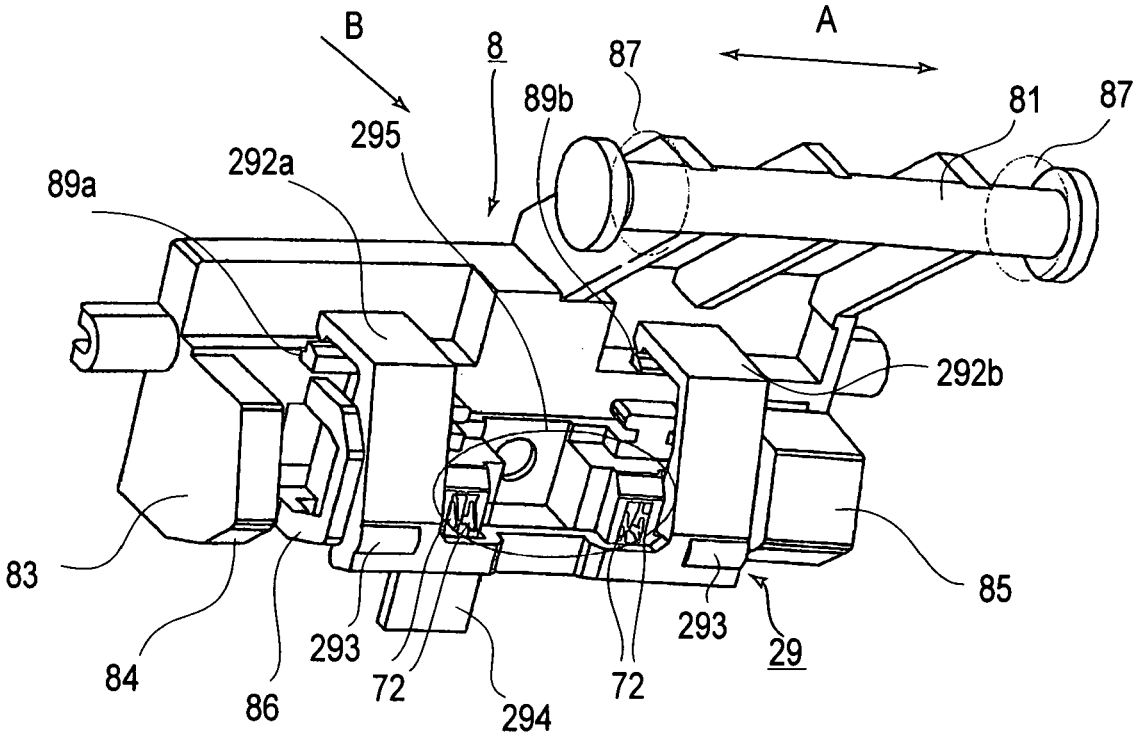
FIG. 14 is a perspective view of the connector attachment portion of the main assembly of the image forming apparatus, fitted with the electrical contact spacing member, and its adjacencies, in the second embodiment of the present invention.
Figure 15:
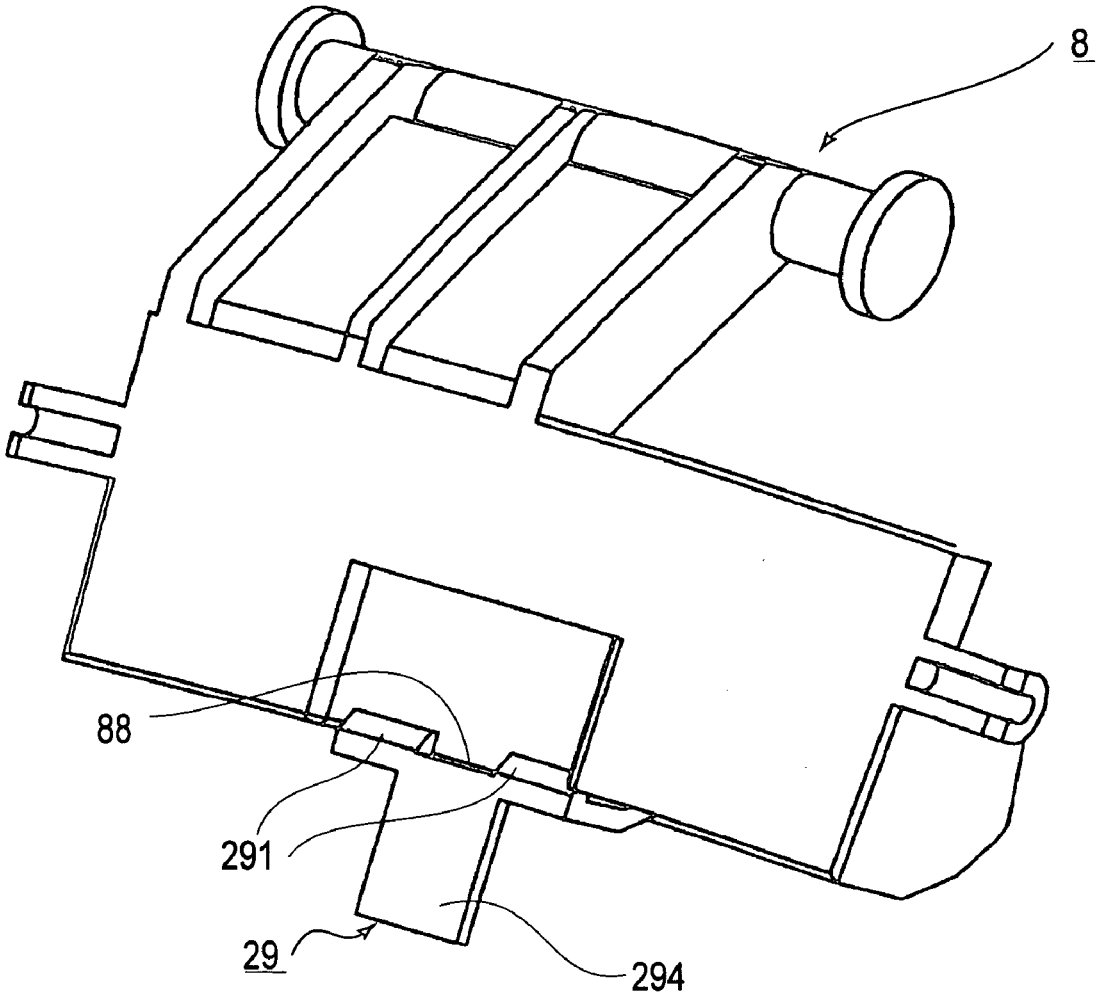
FIG. 15 is also a perspective view of the connector attachment portion of the main assembly of the image forming apparatus, fitted with the electrical contact spacing member, and its adjacencies, in the second embodiment of the present invention.
Figure 16:
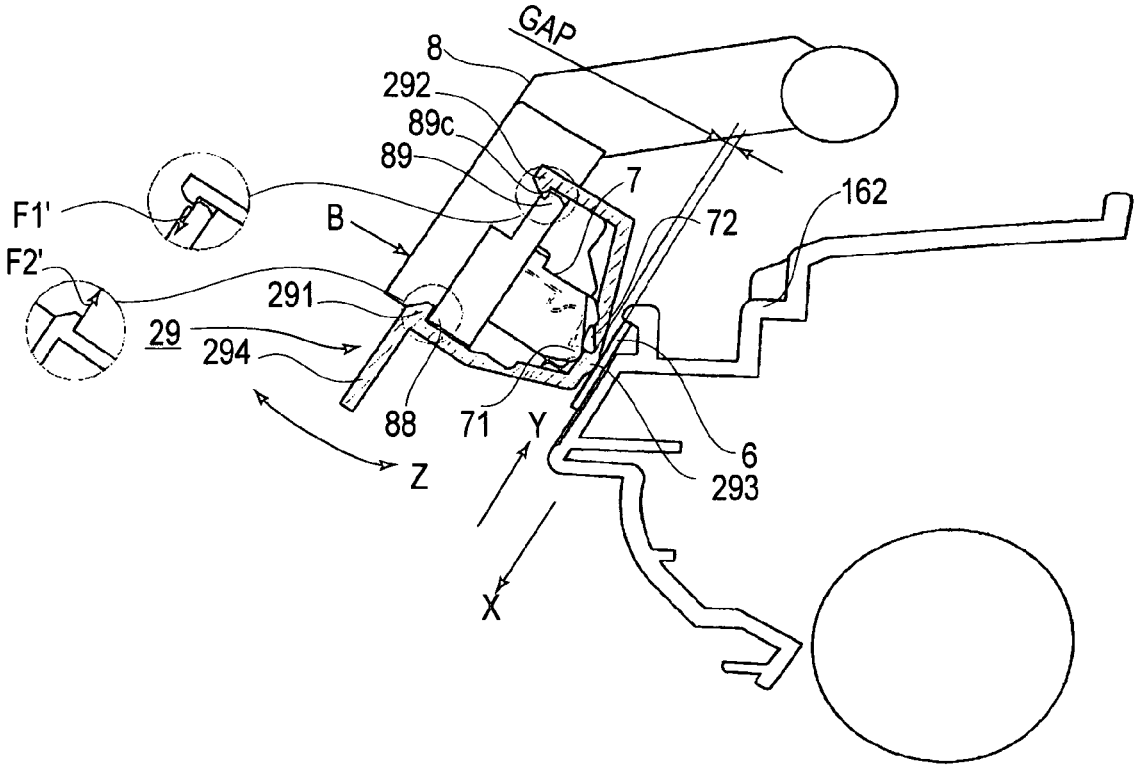
FIG. 16 is a schematic sectional view of the contact area between the process cartridge and the main assembly of the image forming apparatus, fitted with the electrical contact spacing member, and its adjacencies, in the second embodiment of the present invention, after the mounting of the process cartridge into the main assembly.

Referring to FIGS. 14, 15, and 16, the structure of the electrical contact spacing member 29 capable of keeping separated the electrical contacts on the apparatus main assembly side from the electrical contacts 62 of the memory tag 6, when the cartridge P is mounted into the apparatus main assembly E, and keeping them separated while the cartridge P is in the apparatus main assembly E, will be described along with what occurs during the mounting of the process cartridge P into the apparatus main assembly E equipped with the spacing member 29.

FIGS. 14 and 15 are perspective views of the connector attachment portion of the apparatus main assembly E, which is fitted with the spacing member 29. FIG. 16 is a schematic sectional view of the spacing member 29 and its adjacencies, in the apparatus main assembly E equipped with the spacing member 29, after the successful completion of the mounting of the process cartridge P into the apparatus main assembly E.

First, the structures of the connector attachment portion and adjacencies thereof, and the structure of the spacing member 29, in this embodiment will be described.

Referring to FIG. 16, the connector holder 8 is provided with spacing member attachment portions 88, 89*a*, and 89*b*, which are positioned so that the line connecting the center of the line connecting the portions 89*a* and 89*b*, and the center of the portion 88, is roughly parallel to the cartridge insertion or removal direction.

The spacing member 29 has engaging portions by which the spacing member 29 is removably attachable to the connector holder 8. It also has a spacing portion 293 for keeping the distance between the connector holder 8 and cartridge P greater while the apparatus main assembly E is transported than while the apparatus main assembly E is in use (during image formation).

In this embodiment, the spacing member 29 is also provided with engaging portions 292*a* and 292*b*, by which the spacing member 29 can be removably attached to the connector holder 8, and engaging portions 291, which are located on the opposite side of the spacing portion 293 from the engaging portions 292*a* and 292*b*. The engaging portions 291 can also be engaged with the connector holder 8 or disengaged therefrom.

As the spacing member 29 is attached to the cartridge P, the spacing portion 293 covers the mechanical contact portions 71 of the connector holder 8. The mechanical contact portions 71 are the portion for regulating the position of the connector holder 8 relative to the cartridge P to ensure that the contact pressure between the electrical contacts 62 of the memory tag 6 and the electrical contacts 72 on the main assembly side remains at the predetermined value while the apparatus main assembly E is in use. Further, the spacing portions 293 contact the mechanical contact portions 63 of the memory tag 6. Therefore, the electrical contacts 62 are prevented from coming into contact with the electrical contacts 72. In other words, a certain amount of gap is maintained between the electrical contacts 62 and electrical contacts 72. Therefore, even if the cartridge P is left mounted in the apparatus main assembly E when the apparatus main assembly E is transported, the electrical contacts 72 and electrical contacts 62 are prevented from being damaged.

Further, the spacing member 29 is provided with holes 295 and a handle portion 294, also called a tab portion. The holes 295 are surrounded by the corresponding engaging portions 291, 292*a*, and 292*b*, and the spacing portions 293. The holes 295 correspond in position to the electrical contacts 62, one for one, enabling the spacing member 29 to keep the electrical contacts 62 separated from the electrical contacts 72, without coming into contact with the electrical contacts 72 of the connector 7. In other words, providing the spacing member 29 with the holes 295 makes it possible to reduce the thickness of the spacing member 29, and also, to simplify the shape of the spacing member 29. Therefore, not only can the spacing member 29 be easily manufactured, but also, it can be reduced in cost.

As for the removal of the spacing member 29, the spacing member 29 is to be rotated by the tab portion 294 about the engaging portions 292*a* and 292*b* in the direction indicated by an arrow mark Z, which is roughly perpendicular to the cartridge insertion direction indicated by an arrow mark X or cartridge removal direction indicated by an arrow mark Y. Since the tab portion 294 is located a certain distance away from the engaging portions 292*a* and 292*b*, the spacing member 29 can be easily removed by the above described action.

Next, the relationship among the connector 7, the memory tag 6, and the spacing member 29 will be described, sequentially following the steps through which the cartridge P is mounted into the apparatus main assembly E fitted with the spacing member 29.

As the cartridge P is inserted into the apparatus main assembly E, first, the positioning portion 83 enters the positioning portion 67, precisely positioning the connector 7 in terms of the lengthwise direction of the connector 7 (arrow A direction in FIG. 14).

Then, the mechanical contact portions 65*a* and 66*a* of the cartridge P come into contact with the guiding ribs 84 and 85 of the apparatus main assembly E. At the moment of this contact, the electrical contacts 72 and mechanical contact portions 71 of the connector 7 have yet to come into contact with the memory tag 6, the cartridge frame 162 which is holding the memory tag 6, and the spacing member 29. Then, the cartridge P is further inserted, with the mechanical contact portions 65*a* and 66*a* remaining in contact with the guiding ribs 84 and 85. As the cartridge P is further inserted, the mechanical contact portions 65*a* and 66*a* slide off from the guiding ribs 84 and 85. As a result, the clearance providing portions 65*b* and 66*b*, which extend rearward from the mechanical contact portions 65*a* and 66*a* in terms of the cartridge insertion direction, oppose the guiding ribs 84 and 85; in other words, the drum frame 162 becomes separated from the guiding ribs 84 and 85.

At the same time, the mechanical contact portions 71 of the connector 7 are covered with the spacing portions 293 of the spacing member 29. As a result, the spacing portions 293 are sandwiched by the mechanical contact portions 71 and the mechanical contact portions 63 of the memory tag 6, keeping the electrical contacts 72 separated from the contact portions 62. Consequently, the electrical contacts 72 are prevented thereafter from coming into contact with the electrical contacts 62 of the memory tag 6.

As the mechanical contact portions 71 of the connector 7 come into contact with the spacing portions 293 of the spacing member 29, and press thereupon, a force F1' is applied to the spacing member 29 in the same direction as the cartridge insertion direction. However, as described above, the spacing member 29 and connector holder 8 are structured so that the spacing member 29 engages with the spacing member attachment portion of the spacing member attachment portion of the connector holder 8 so that it will not disengage from the spacing member attachment portion, in the direction intersecting to the cartridge insertion direction or cartridge removal direction. Therefore, even though the spacing member 29 is subjected to the force F1', the force F1' acts in the direction to press the spacing member 29 upon the connector holder 8. Therefore, the spacing member 29 does not disengage from the spacing member attachment portion of the connector holder 8.

In other words, the engaging portions 292 (92*a* and 292*b*) located on the trailing end of the cartridge P in terms of the cartridge insertion direction X are pressed upon the connector holder 8 as the cartridge P is mounted into the apparatus main assembly E. Therefore, the spacing member 29 does not disengage from the connector holder 8.

As described above, as long as the connector holder 8 is fitted with the spacing member 29, even after the mounting of the cartridge P into the apparatus main assembly E, the electrical contacts 72 and electrical contacts 62 remain isolated from each other by the spacing member 29, being thereby prevented from being deformed and/or frictionally worn while the image forming apparatus main assembly E is transported.

The apparatus main assembly E and the cartridge P therein are delivered to a user while remaining in the above described condition. Then, a user is to open the shipment box, in which they have been delivered. Next, the electrophotographic image forming apparatus is to be taken out of the shipment box. Next, the cartridge P is to be removed from the apparatus main assembly E in order to remove the spacing member 29. The following is the description of the detail of the process of removing the spacing member 29.

First, the user is to remove the apparatus main assembly E from the shipment box, and remove the cartridge P from the apparatus main assembly E by opening the door D. When the cartridge P is removed from the apparatus main assembly E, the spacing member 29 is subjected to a force F2' which acts in the same direction as the cartridge removal direction. However, as described above, the spacing member 29 and connector holder 8 are structured so that once the spacing member 29 and connector holder 8 are engaged with each other, they cannot be disengaged in the direction roughly perpendicular to the cartridge insertion or removal direction. Therefore, the spacing member 29 is pressed upon the connector holder 8, and therefore, does not become disengaged from the connector holder 8.

In other words, when the cartridge P is removed from the apparatus main assembly E, first, the engaging portions 291 located at the trailing end of the cartridge P in terms of the cartridge removal direction are pressed upon the connector holder 8. Therefore, it does not occur that the spacing member 29 becomes disengaged from the connector holder 8. Incidentally, all that is necessary is that the force F1' which applies to the engaging portions 292, and the force F2' which applies to the engaging portions 291 are opposite in direction. In other words, the combination may be reversed.

As the cartridge P is moved further outward, the mechanical contact portions 65*a* and 66*a* come into contact with the guiding ribs 84 and 85, which were located opposite the clearance providing portion 65*b* and 66*b* of the drum frame 162. In this condition, the electrical contacts 72 and mechanical contact portions 71 are not in contact with the memory tag 6, the cartridge frame 162, and the spacing member 29. Then, as the cartridge P in this condition is pulled outward of the apparatus main assembly E, the mechanical contact portions 65*a* and 66*a* become disengaged from the guiding ribs 84 and 85, and the cartridge P comes out of the apparatus main assembly E, with no deformation and/or frictional wear to the electrical contacts 72 nor the electrical contacts 62. Next, the user is to grasp the tab portion 294 of the spacing member 29, and rotate the spacing member 29 by the tab portion 294 in the spacing member removal direction Z (roughly perpendicular to cartridge insertion or removal direction). With this action, the spacing member 29 easily disengages from the connector holder 8.

[Embodiment 3]

The above described first and second embodiments are concerned with the structural arrangement for keeping the electrical contacts of the memory tag 6 of the cartridge P separated from the electrical contacts 72 of the apparatus main assembly E. However, the application of the present invention is not limited to the electrical contacts described above.

For example, the present invention can be applied, with beneficial results, to keep the electrical contacts 153 of the cartridge P for charging the photosensitive drum, separated from the electrical contacts 125 of the apparatus main assembly E for charging the photosensitive drum, and also, to keep the electrical contacts 165 of the cartridge P for development, separated from the electrical contacts 126 of the apparatus main assembly E for development.

(Miscellanies)

In the preceding embodiments of the present invention, the movable member was on the main assembly side of the image forming apparatus. However, the above described structural arrangement for the electrical contacts is also compatible with an image forming apparatus structured so that a process cartridge is provided with the movable member.

Further, the preceding embodiments of the present invention were described with reference to the laser beam printer as an example of an electrophotographic image forming apparatus. However, the application of the present invention is not limited to a laser beam printer.

As for the electrophotographic image forming apparatus, other than a laser beam printer, to which the present invention is applicable, the present invention is applicable to any electrophotographic image forming apparatus which forms an image on recording medium such as recording paper, OHP sheet, fabric, etc. For example, the present invention can be applied, with beneficial results, to an electrophotographic copying machine, an electrophotographic printer (for example, LED printer, laser beam printer, etc.), an electrophotographic facsimile machine, an electrophotographic wordprocessor, etc.

Further, the preceding embodiments were described with reference to the process cartridge in which a charging means, a developing means or a cleaning means, and an electrophotographic photosensitive member, are integrally disposed, and which is removably mountable in the main assembly of an electrophotographic image forming apparatus. However, the application of the present invention is not limited to the above described process cartridge.

In other words, the present invention is also applicable to a process cartridge in which at least one processing means among a charging means, a developing means, and a cleaning means, and an electrophotographic photosensitive member, are integrally disposed, and which is removably mountable in the main assembly of an electrophotographic image forming apparatus, and a process cartridge in which at least a developing means and an electrophotographic photosensitive member are integrally disposed, and which is removably mountable in the main assembly of an electrophotographic image forming apparatus.

In addition, the present invention is applicable to a development cartridge in which the developer to be used by a developing means is stored, to be supplied to a process cartridge such as the above described one, and which is removably mountable in the main assembly of an electrophotographic image forming apparatus.

Moreover, the present invention is applicable to a fixation unit which is for fixing the unfixed image on recording medium, and which is removably mountable in the main assembly of an electrophotographic image forming apparatus.

As described above, the present invention makes it possible to prevent the electrical contacts of the main assembly of an electrophotographic image forming apparatus, and the electrical contacts of a unit, from being damaged when the electrophotographic image forming apparatus is transported with the unit remaining mounted therein.

Further, the present invention makes it possible to prevent the electrical contacts of the main assembly of an electrophotographic image forming apparatus, and the electrical contacts of a unit, from being deformed or frictionally worn, when the electrophotographic image forming apparatus is transported with the unit remaining mounted therein.

Moreover, the present invention can improve the efficiency with which a unit and an electrophotographic image forming apparatus are transported.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 066364/2004 filed Mar. 9, 2004, which is hereby incorporated by reference.

What is claimed is:

1. An electrophotographic image forming apparatus for forming an image on a recording material, to which a unit is detachably mountable, wherein said electrophotographic image forming apparatus is transportable with said unit mounted thereto, said electrophotographic image forming apparatus comprising:

(i) a movable member;

(ii) a main assembly electrical contact provided on said movable member;

(iii) a mounting member configured and positioned to demountably mount said unit;

(iv) said unit mounted to said mounting member, wherein said unit has a unit electrical contact electrically contactable to said main assembly electrical contact in an image forming operation for forming the image on the recording material; and (v) a separating member configured and positioned to separate said main assembly electrical contact and said unit electrical contact from each other by contacting said movable member and said unit to provide a gap between said main assembly electrical contact and said unit electrical contact when said electrophotographic image forming apparatus is transported with said unit mounted to said electrophotographic image forming apparatus.

2. An apparatus according to claim 1, wherein said separating member is removably provided on said unit.

3. An apparatus according to claim 1, wherein said separating member is removably provided on said movable member.

4. An apparatus according to claim 1 or 2, wherein said movable member has a supporting member configured and positioned to support said main assembly electrical contact, and when said electrophotographic image forming apparatus is transported with said unit is mounted thereto, said supporting member and said separating member are contacted to each other to separate said main assembly electrical contact and said unit electrical contact separating from each other.

5. An apparatus according to claim 1 or 2, wherein said movable member has a contact portion configured and positioned to contact said unit to contact said unit electrical contact and said main assembly electrical contact to each other at a predetermined pressure in the image forming operation, wherein when said electrophotographic image forming apparatus is transported with said unit mounted thereto, said separating member contacts said contact portion to separate said main assembly electrical contact and said unit electrical contact from each other.

6. An apparatus according to claim 2, wherein said separating member has an opening configured and positioned to expose said unit electrical contact.

7. An apparatus according to claim 1 or 3, wherein said unit has a base plate on a surface of which said unit electrical contact is provided, and when said electrophotographic image forming apparatus is transported with said unit mounted thereto, said base plate and said separating member are contacted to each other to separate said main assembly electrical contact and said unit electrical contact from each other.

8. An apparatus according to claim 3, wherein said separating member has an opening configured and positioned to expose said main assembly electrical contact.

9. An apparatus according to claim 1, wherein said unit is a process cartridge including an electrophotographic photosensitive member and process means actable on said electrophotographic photosensitive member.

10. An apparatus according to claim 1, wherein said separating member has a grip portion configured and positioned to facilitate removal of said separating member from said unit or from said movable member.

11. A separating member usable when an electrophotographic image forming apparatus is transported with a unit mounted thereto, wherein the unit has a unit electrical contact and is detachably mountable to the electrophotographic image forming apparatus, and the electrophotographic image forming apparatus is capable of forming an image on a recording material and has a main assembly electrical contact contactable to the unit electrical contact in an image forming operation for forming an image on the recording material with the unit mounted to the electrophotographic image forming apparatus, wherein said separating member is effective to separate the main assembly electrical contact and the unit electrical contact by providing a gap between the main assembly electrical contact and the unit electrical contact by contacting the unit and a movable member, when the electrophotographic image forming apparatus is transported with the unit mounted to the electrophotographic image forming apparatus, wherein the movable member is provided in the main assembly of the apparatus and supports the main assembly electrical contact.

12. An apparatus according to claim 11, wherein said separating member is capable of being mounted to the unit.

* * * * *

UNITED STATES PATENT AND TRADEMARK OFFICE

CERTIFICATE OF CORRECTION

PATENT NO. : 7,203,442 B2
APPLICATION NO. : 11/072506
DATED : April 10, 2007
INVENTOR(S) : Hideyuki Matsubara et al.

It is certified that error appears in the above-identified patent and that said Letters Patent is hereby corrected as shown below:

ON THE TITLE PAGE:
At Item (75), Inventors:, "Shizuoko-ken (JP);" should read --Shizuoka-ken (JP);--.

COLUMN 3:
Line 46, "is laser" should read --is a laser--.

COLUMN 5:
Line 21, "station 2," should read --station,--.

COLUMN 7:
Line 58, "into the its" should read --into its--.

COLUMN 10:
Line 4, "contacts-72" should read --contacts 72--.

COLUMN 12:
Line 25, "intersecting to" should read --intersecting--.

COLUMN 15:
Line 42, "spacing member attachment portion of the" should be deleted.
Line 45, "intersecting to" should read --intersecting--.

COLUMN 18:
Line 50 Claim 4, "is mounted" should read --mounted--.

Signed and Sealed this

Seventeenth Day of February, 2009

JOHN DOLL
*Acting Director of the United States Patent and Trademark Office*